US005388277A

United States Patent [19]

Taniuchi

[11] Patent Number: 5,388,277

[45] Date of Patent: Feb. 14, 1995

[54] AIR INTAKE DEVICE IN HELMET

[75] Inventor: Fujio Taniuchi, Tokyo, Japan

[73] Assignee: Shoei Kako Kabushiki Kaisha, Tokyo, Japan

[21] Appl. No.: 177,935

[22] Filed: Jan. 6, 1994

[30] Foreign Application Priority Data

Aug. 11, 1993 [JP] Japan ..... 5-043984[U]

[51] Int. Cl.[6] ..... A42B 1/08

[52] U.S. Cl. ..... 2/422; 2/424; 2/171.3

[58] Field of Search ..... 2/410, 411, 422, 424, 2/425, 436, 437, 9, 171.3, 184.5

[56] References Cited

U.S. PATENT DOCUMENTS 5,093,938 3/1992 Kamata ..... 2/424

5,212,843 5/1993 Kamata ..... 2/424

*Primary Examiner*—Clifford D. Crowder

*Assistant Examiner*—Michael A. Neas

*Attorney, Agent, or Firm*—Armstrong, Westerman, Hattori, McLeland & Naughton

[57] ABSTRACT

In an air intake device in a helmet, a recess is defined in a front wall of a shell of a cap body so as to be recessed inwardly of the shell, and has an opening defined in an upper surface of the recess to communicate with the inside of the cap body. A shutter plate is inserted into the opening for opening and closing the recess. A guide rod is projectingly disposed on a back surface of the shutter plate, so that it comes into sliding contact with an innermost wall of the recess and is slidably received in a guide hole provided in a lower wall of the recess. The shell of the cap body is provided with a function of a shutter housing, thereby eliminating the need for an exclusive shutter housing and simplifying the air intake device.

1 Claim, 7 Drawing Sheets

AIR INTAKE DEVICE IN HELMET

BACKGROUND OF THE INVENTION

1. Field of the Invention

The field of the present invention is helmets for use mainly by an occupant on a motorcycle or a racing car, and particularly, air intake devices for ventilation of the inside of a cap body.

2. Description of the Prior Art

Such air intake devices in the helmets are already know, for example, from Japanese Utility Model Publication No. 7211/93. In the disclosed air intake device, a shutter housing for vertically movably retaining a shutter plate is joined to an outer surface of a cap body, and an air intake hole capable of communicating with an air duct in the cap body is provided in the shutter housing.

In the prior art air intake device, the shutter housing separate from the cap body is required in order to retain the shutter plate. Therefore, working steps such as forming and mounting of the shutter housing are an obstacle to a reduction in cost, and a simplification in structure is desired.

SUMMARY OF THE INVENTION

Accordingly, it is an object of the present invention to provide an air intake device of a simple structure, wherein a shell itself of a cap body has a function of a shutter housing.

To achieve the above object, according to the present invention, there is provided an air intake device in an air intake device in a helmet, comprising: a shell of a cap body formed with a recess which is recessed inwardly from a front surface of the shell and is provided at an upper surface of the recess with an opening which is communicated with an interior of the cap body; a shutter plate which is vertically movable along an inner surface of the shell at a position immediately above the recess for opening and closing the recess; a guide rod projectingly provided on a back surface of the shutter plate for sliding contact with an innermost wall of the recess; and a guide hole perforated in a lower wall of the recess for slidably receiving the guide rod.

With the above construction, it is possible that the shell can function to retain the shutter plate, thereby eliminating the need for an exclusive shutter housing, which largely contributes to a simplification in structure of the air intake device and, to a reduction in production cost.

The above and other objects, features and advantages of the invention will become apparent from the following description of a preferred embodiment taken in conjunction with the accompanying drawings.

DESCRIPTION OF THE PREFERRED EMBODIMENT

The present invention will now be described by way of a preferred embodiment in connection with the accompanying drawings.

Figure 1:
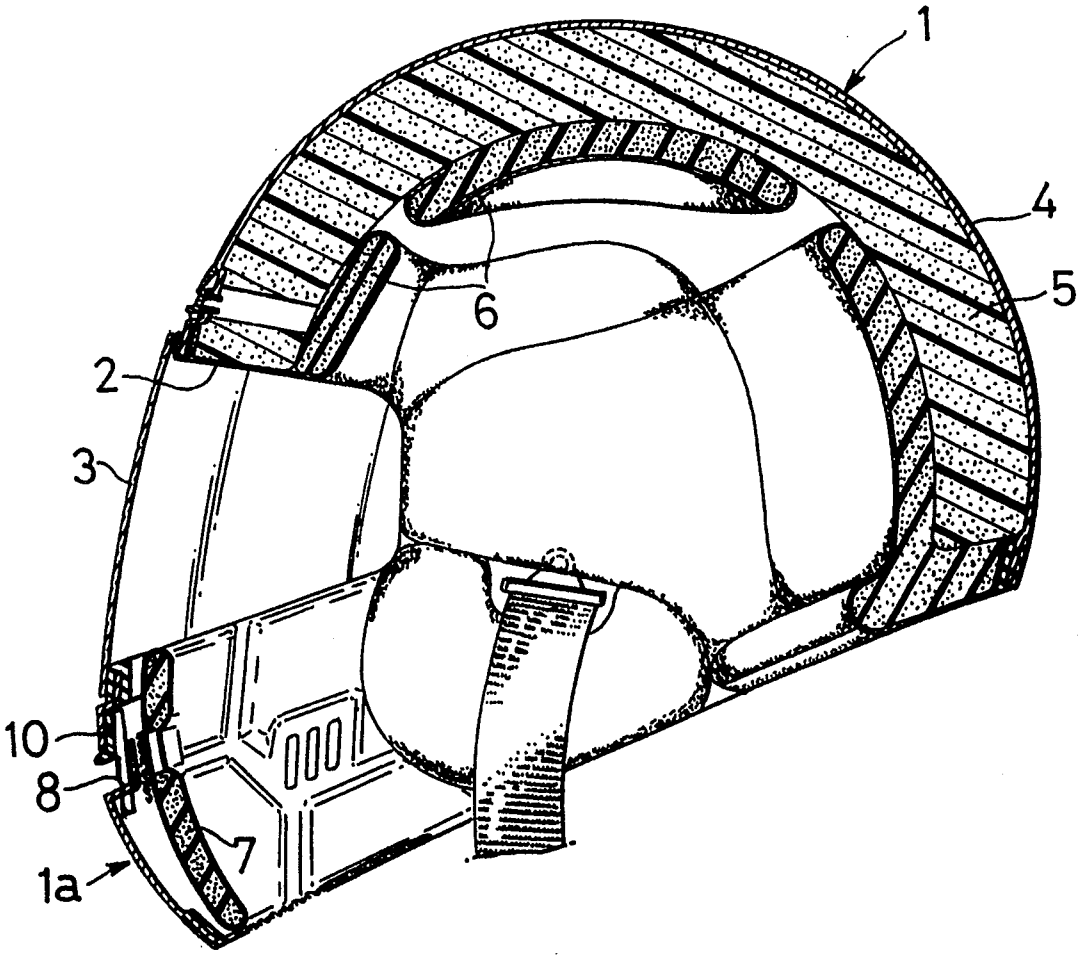
FIG. 1 is a longitudinal sectional side view of a helmet including an air intake device according to a preferred embodiment of the present invention.

Referring first to FIG. 1, a cap body 1 of a riding helmet is formed into a full face type having a chin covering portion 1*a* provided immediately below a window 2 opened at a front surface of the cap body 1, and includes a shield plate 3 for opening and closing the window 2. The cap body 1 further includes a shell 4 made of FRP, a shock absorbing liner 5 made of expanded polystyrene material mounted to an inner surface of the shell 4 excluding the chin covering portion 1*a*, a fit pad 6 made of urethane foam material mounted in place on an inner surface of the shock absorbing liner 5, and a chin pad 7 made of urethane foam material mounted on an inner surface of the shell 5 at the chin covering portion 1*a*.

As shown in FIGS. 2, 3, 5 and 6, a laterally elongated recess 8 is formed in a central portion of the shell 4, such that the recess 8 is recessed inwardly into the shell 4. And a shutter plate 10 is also disposed on the central portion of the shell 4 for opening and closing an opening in a front surface of the recess 8.

The recess 8 is provided at an upper surface thereof with an opening 9. And a through hole 11 is perforated in an innermost wall of the recess 8. Further, a pair of left and right guide holes 12, 12 are provided in a lower wall of the recess 8.

The shutter plate 10 is disposed such that it can move vertically within the shell 8 along the inner surface of the shell 4 at a position immediately above the recess 8. And a pair of guide rods 13, 13 are integrally provided on a back surface of the shutter plate 10. These guide rods extend downwardly in sliding contact with the innermost wall of the recess 8, and are slidably received into guide holes 12, 12.

The shutter plate 10 is continuously provided at a lower edge thereof with a knob 14 which projects forwardly of the recess 8. The abutment of the knob 14 against an upper edge of the recess 8 restrains a lifted position A (see FIGS. 2 and 3) of the shutter plate 10 in which the recess 8 is fully opened. On the other hand, the abutment of the knob 14 against a lower edge of the recess 8 restrains a lowered position B (see FIGS. 4 and 5) of the shutter plate 8 in which the recess 8 is fully closed.

Several notches 15, 15 are vertical arranged in a front surface of the shutter plate 10. And a small projection 16 is provided on the inner surface of the shell 4, so that they are selectively brought into engagement with one of the notches 15, 15 by a resilient force of the shell 4 so as to retain the shutter plate 10 at a desired opened position.

A plurality of wind guide holes 17, 17 are provided in the chin pad 7 in an opposed relation to the innermost wall of the recess 8. A mesh-like filter 18 is affixed to a front surface of the chin pad 7 for covering the wind guide holes 17, 17.

A flange 4*a* is continuously formed to an upper edge of the shell 4 at the chin covering portion 1*a* in such a manner that it is offset inwardly of the shell 4. A sealing member 19 having a U-shaped section is mounted to the flange 4*a* to come into contact with an inner surface of the shield plate 3.

A large number of projections 20, 20—are formed on an outer surface of a rear wall 19*a* of the sealing member 19 to extend vertically into abutment against a front surface of the chin pad 7. And a large number of second wind guide holes 21, 21—are defined between the adjacent projections 20, 20—to communicate with the opening 9 of the recess 8.

The operation of this embodiment will be described below.

Figure 7:
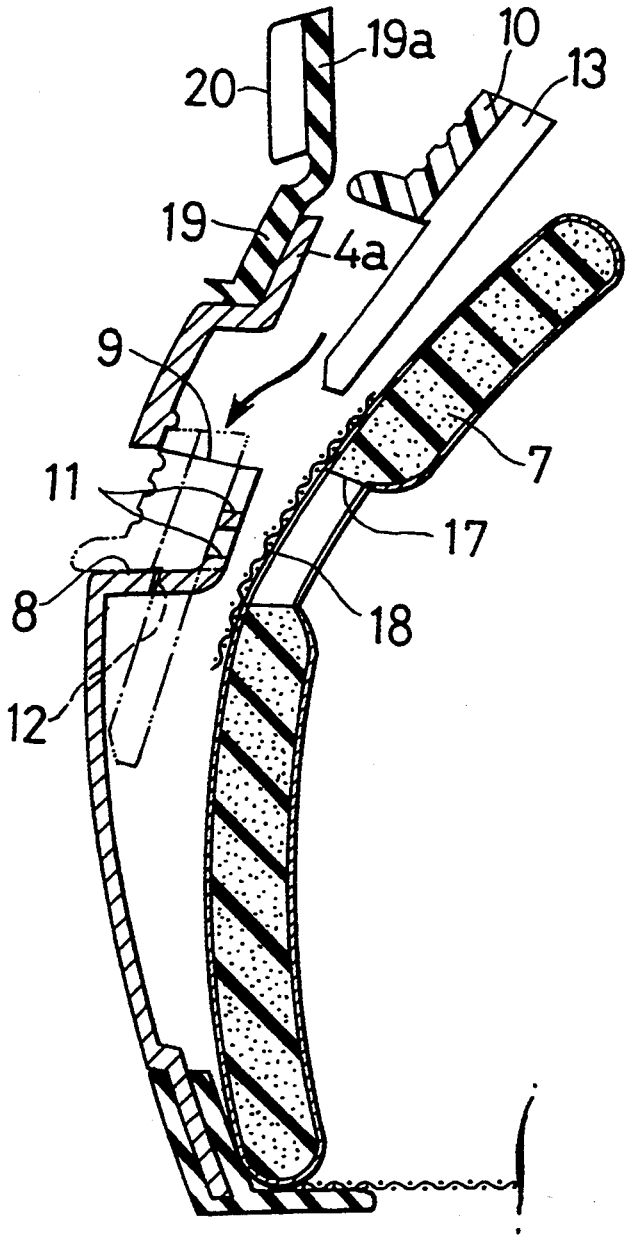
FIG. 7 is a sectional view similar to FIG. 3, illustrating the way of mounting of the shutter plate.

In attaching the shutter plate 10, the chin pad 7 is pushed rearwardly, i.e., inwardly of the cap body 1, and the rear wall 19*a* of the sealing member 19 is turned upwardly, as shown in FIG. 7. In this state, the shutter plate 10 is accommodated from the inside of the shell 4 at the chin covering portion la through the opening 9 into the recess 8, and the guide rods 13 are inserted into the guide holes 12. At this time, it is desirable to resiliently deform the shell 4 so as to widen the opening 9 in order to facilitate the accommodation of the shutter plate 10 into the recess 8.

Figure 2:
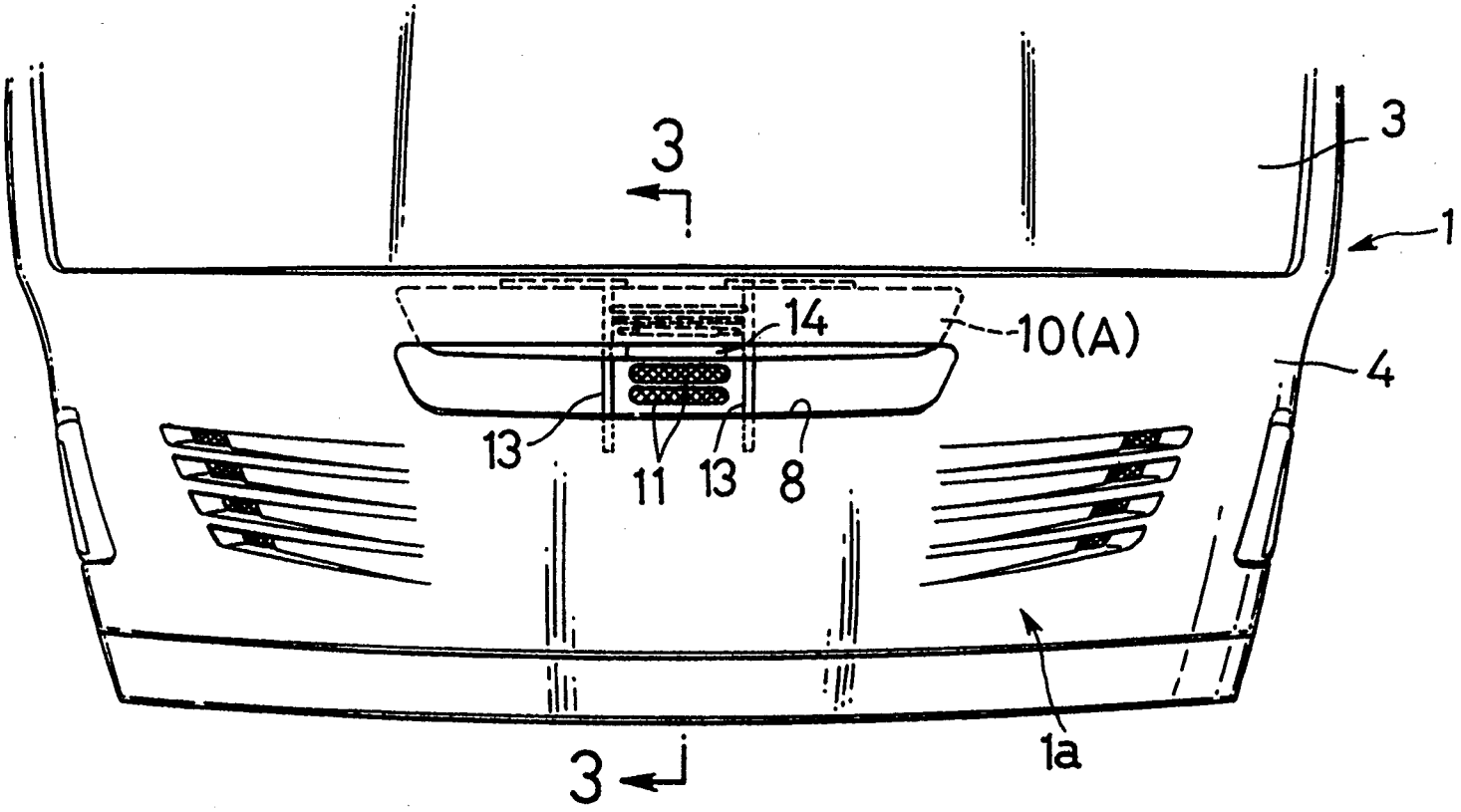
FIG. 2 is a front view of an essential portion of the helmet.
Figure 3:
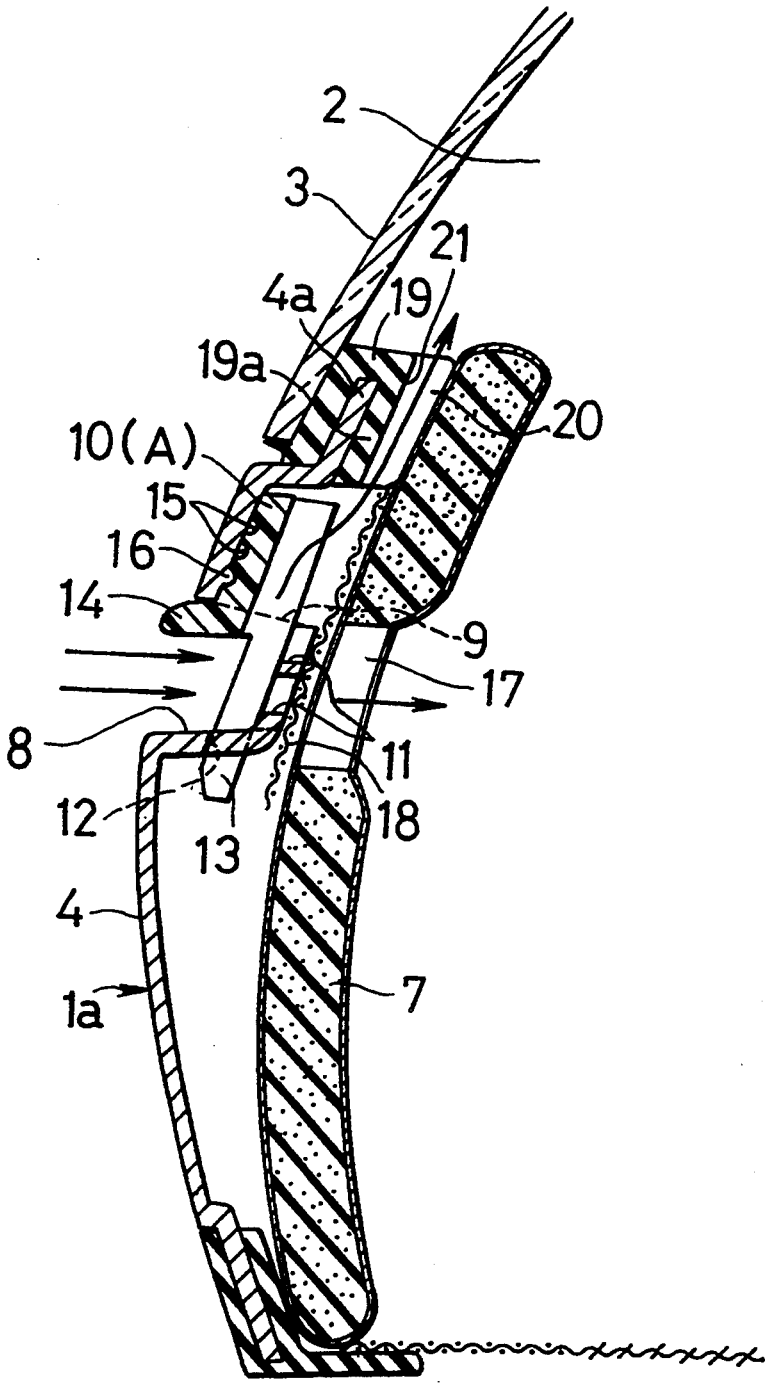
FIG. 3 is a sectional view taken along line 3—3 in FIG. 2.

If a driver of a motorcycle wears the helmet according to the present invention with the shutter plate 10 lifted to open the recess 8, as shown in FIGS. 2 and 3, the traveling air generated when driving the motorcycle enters the recess 8, and a portion of the traveling air is filtered by the filter 18 and passed through the first wind guide holes 17 into the chin covering portion 1*a* to ventilate a portion around a user's mouth. The other portion of the traveling air from the recess 8 is passed through the opening 9 and ejected upwardly from the second wind guide holes 21, 21—to flow upwardly along the inner surface of the shield plate 3. Thus, it is possible to eliminate the clouding of the inner surface of the shield plate 3 due to an exhalation of the user.

Figure 4:
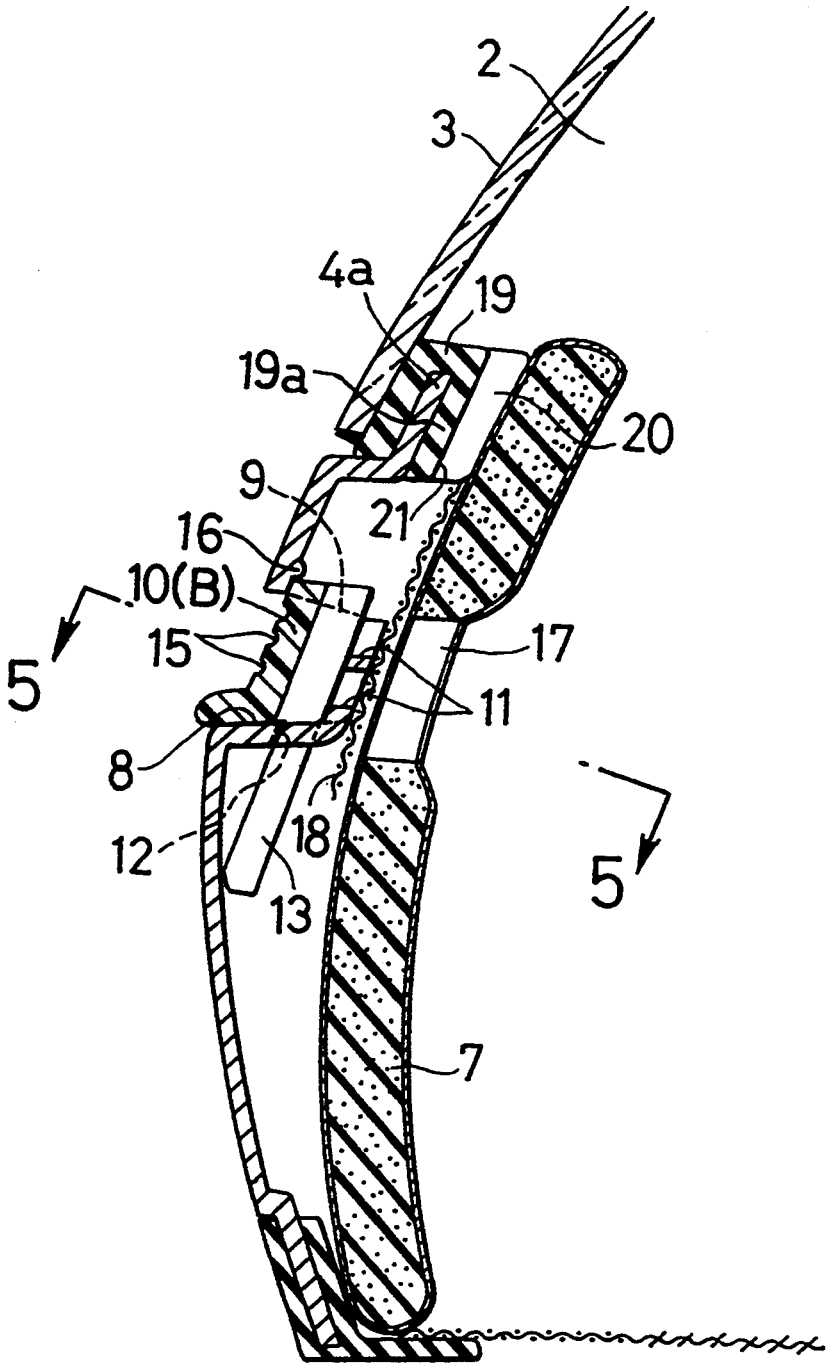
FIG. 4 is a sectional view similar to FIG. 3, illustrating a fully closed state of a shutter plate.
Figure 5:
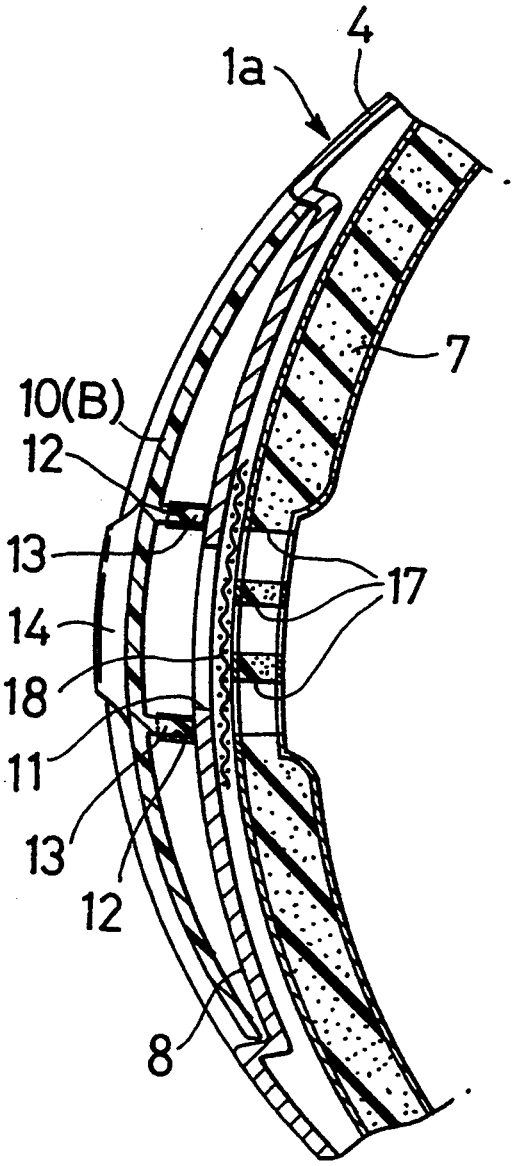
FIG. 5 is a sectional view taken along line 5—5 in FIG. 4.
Figure 6:
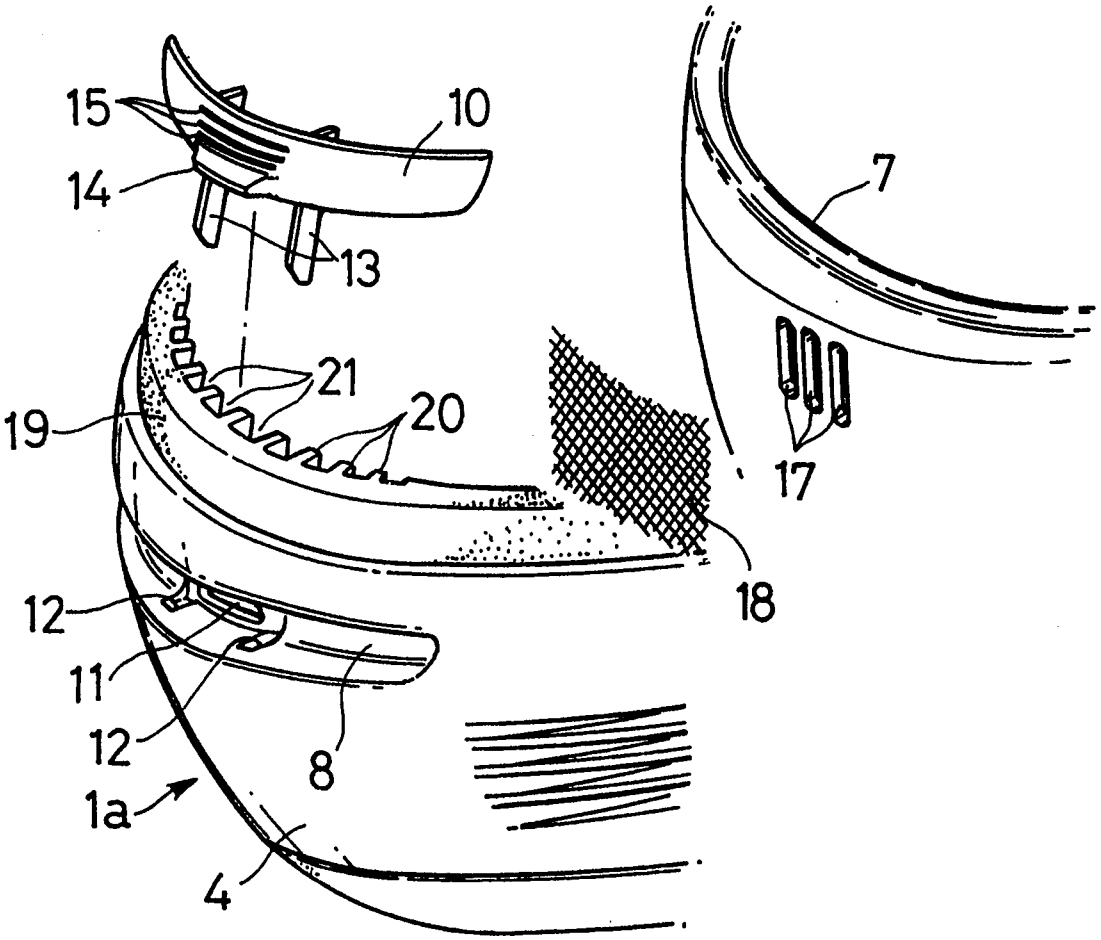
FIG. 6 is an exploded perspective view of the air intake view according to the present invention.

Next, if the shutter plate is lowered to a moderate extent by operating the knob 14 using user's fingers, the opening degree of the recess 8 is adjusted in accordance with the amount of knob 14 lowered. Therefore, the amount of traveling air introduced into the first and second wind guide holes 17 and 21 can be adjusted. If the shutter plate 10 is lowered to the lowermost position as shown in FIGS. 4 and 5, the recess 8 can be fully closed to stop the introduction of the running wind.

The shutter plate 10 is always supported at three points on the shell 4 with a good stability, because the front surface of the shutter plate 10 is in sliding contact with the inner surface of the shell 4 at the chin covering portion 1*a*, and the guide rods 13 are in sliding contact with the innermost wall of the recess 8 and received in the guide holes 12 in the lower wall of the recess 8. Therefore, the shell 4 functions as a shutter housing for retaining the shutter plate 10 and thus, there is no need for providing an exclusive shutter housing.

Although the present invention has been described in connection with the preferred embodiment, it will be understood that the present invention is not limited thereto, and various modifications in design can be made without departing from the spirit and scope of the invention defined in claims. For example, the air intake device according to the present invention may be provided immediately above the window 2 in the cap body 1, and the opening 9 of the recess 8 may be put into communication with an air duct in the shock absorbing liner 5.

What is claimed is:

1. A helmet having an air intake device, comprising:

a shell of a cap body formed with a recess which is recessed inwardly from a front surface of the shell and is provided at an upper surface of the recess with an opening which is communicated with an interior of the cap body;

a shutter plate which is vertically movable along an inner surface of the shell at a position immediately above the recess for opening and closing the recess;

a guide rod projectingly provided on a back surface of the shutter plate for sliding contact with an innermost wall of the recess; and a guide hole perforated in a lower wall of the recess for slidably receiving said guide rod.

* * * * *